United States Patent [19]

Hanna

[11] Patent Number: 4,996,423

[45] Date of Patent: Feb. 26, 1991

[54] CHOP MODE OPERATED MASS SPECTROMETER FOR REDUCING THE EFFECT OF LINE SIGNALS

[75] Inventor: David A. Hanna, Boulder, Colo.

[73] Assignee: Paradygm Science & Technologies, Inc., Boulder, Colo.

[21] Appl. No.: 532,448

[22] Filed: Jun. 4, 1990

[51] Int. Cl.[5] ..... H01J 49/02

[52] U.S. Cl. ..... 250/281; 250/282; 250/286; 250/288

[58] Field of Search ..... 250/281, 282, 286, 288

[56] References Cited

U.S. PATENT DOCUMENTS

| | | | |
|---|---|---|---|
| 3,992,626 | 11/1976 | Bursack | 250/288 |
| 4,068,122 | 1/1978 | Schmidt et al. | 250/281 |
| 4,201,913 | 5/1980 | Bursack et al. | 250/288 |
| 4,258,427 | 3/1981 | Fayre et al. | 364/527 |
| 4,409,482 | 10/1983 | Scheid et al. | 250/282 |
| 4,695,724 | 9/1987 | Watanabe et al. | 250/292 |

FOREIGN PATENT DOCUMENTS 2562323 10/1985 France .

*Primary Examiner*—Jack I. Berman
*Attorney, Agent, or Firm*—Sheridan, Ross & McIntosh

[57] ABSTRACT

The present invention provides a chop mode operated mass spectrometer that substantially reduces the effects of line signals on the operation of the mass spectrometer by admitting gas samples to the analyzer of the mass spectrometer at a frequency that is a sub-multiple of the line frequency. The signal output by the analyzer is sampled at a frequency that is a multiple of frequency at which the gas is being admitted to the analyzer and processed using a digital filter that results in the line signal being isolated from the signal or signals of interest.

14 Claims, 1 Drawing Sheet

CHOP MODE OPERATED MASS SPECTROMETER FOR REDUCING THE EFFECT OF LINE SIGNALS

BACKGROUND OF THE INVENTION

1. Field of the Invention

The present invention relates to a mass spectrometer that is operated in a chop mode to substantially reduce the adverse effects of undesirable background signals on the operation of the mass spectrometer and, in particular, the effect of line signals on the operation of the mass spectrometer.

2. Description of the Related Art

Mass spectrometers are used to analyze the composition of a gas based upon the different masses of the components of the gas. For example, an appropriately configured mass spectrometer would identify nitrogen and oxygen as two of the constituents of an unidentified sample of air based on the difference in their masses, 28 amus and 32 amus, respectively. The typical mass spectrometer includes an evacuated chamber into which a sample of the gas to be analyzed is admitted. The evacuated chamber provides a vacuum environment that facilitates analysis of the molecular components of the gas sample based on their mass. To maintain the vacuum in the evacuated chamber, a vacuum pump, such as an ion pump, is employed. A valve or other regulating device is used to control the amount of gas admitted into the evacuated chamber so that the vacuum environment is not destroyed by exceeding the capacity of the vacuum pump. Located within the evacuated chamber are the instruments for analyzing the molecular components of the gas sample based on their mass and at least one detector for providing a signal indicative of the presence or absence of a particular type of molecule in the gas sample. Processing circuitry, such as amplifiers and filters, are employed to place the signal output by the detector in a meaningful form.

French Pat. No. 2,562,323, which issued to S.a.r.1. Laboratoire d'Etude des Surfaces, published on Oct. 4, 1985, and is entitled "Process for Simultaneous Analysis of Several Streams of Gas by Mass Spectrometry, and Operation Thereof", identifies gasses that have accumulated on the walls of the evacuated chamber and in the pumping system as sources of undesirable background signals that can adversely affect the signal to noise ratio of the signal output by the mass spectrometer. To reduce the adverse effects of these undesirable signals, the French patent proposes operating the mass spectrometer in a chop mode where the gas to be analyzed is admitted to the evacuated chamber at a particular frequency by pulsing the valve and the signal output by the evacuated chamber is detected at the same frequency. The patent further indicates that the detection can be accomplished numerically with a microprocessor. Providing the frequencies of the undesirable background signals are substantially less than the frequency at which the gas samples are being admitted to the evacuated chamber, the chop mode of operation substantially isolates the background signals from the signal of interest. More specifically, the chop mode of operation results in an output signal where the background signals are substantially isolated in the DC component of the output signal and the signal of interest, the component of the output signal corresponding to the frequency at which the valve is being driven, is in the AC component of the signal. Due to this isolation, the effects of the undesirable background signals are reduced and the signal to noise ratio is improved.

Unrecognized, however, by the French patent is the undesirable effect that the line signal, the 60 Hz signal that is used in the U.S. to provide the mass spectrometer or machinery located adjacent to the mass spectrometer with power, has on the output signal. To effectively reduce the effects of the line signal on the output signal of the mass spectrometer, the valve would have to be chopped at a frequency of several hundred hertz. This, however, is generally not practicable because the passage within the valve and the evacuated chamber through which the gas sample must flow does not have a sufficient bandwidth to accommodate such a high chop rate. Moreover, a high chop rate requires a corresponding increase in the speed and complexity of the circuitry used to process the signals.

Based on the foregoing, there is a need for a chop mode mass spectrometer that is capable of reducing the effect of line signals on the operation of the mass spectrometer.

SUMMARY OF THE INVENTION

The present invention provides a chop mode mass spectrometer that substantially reduces the effect of a line signal on the operation of the mass spectrometer. The preferred embodiment of the chopped mode mass spectrometer includes an analyzer body that includes an evacuated chamber, a vacuum pump, the instrumentation necessary to separate the constituents of the gas sample based on their masses, and one or more detectors for providing signals indicative of the presence or absence of a particular type of molecule in the gas sample. To admit samples of gas into the analyzer body, the chop mode mass spectrometer employs a valve that is capable of periodic or reciprocating operation. The chop mode mass spectrometer also includes circuitry for driving the valve at a sub-multiple of the line frequency. By driving the valve at a sub-multiple of the line frequency, the signal output by the detector can be digitally processed to effectively isolate the line signal from the signal of interest, the signal at the frequency at which the valve is being chopped. More specifically, the signal output by the detector can be sampled at a frequency that is a multiple of the frequency at which the valve is being pulsed and converted to a digital signal that can be processed using, for example, a digital fourier transform that isolates the line signal from the signal of interest. Advantageously, the chop mode mass spectrometer of the present invention effectively eliminates the adverse effects of the line signal on the operation of the mass spectrometer using a signal to drive the valve that is well within the bandwidth of the valve and the analyzer body and that does not require complex, high speed, processing circuitry.

DESCRIPTION OF THE PREFERRED EMBODIMENT

Figure 1:
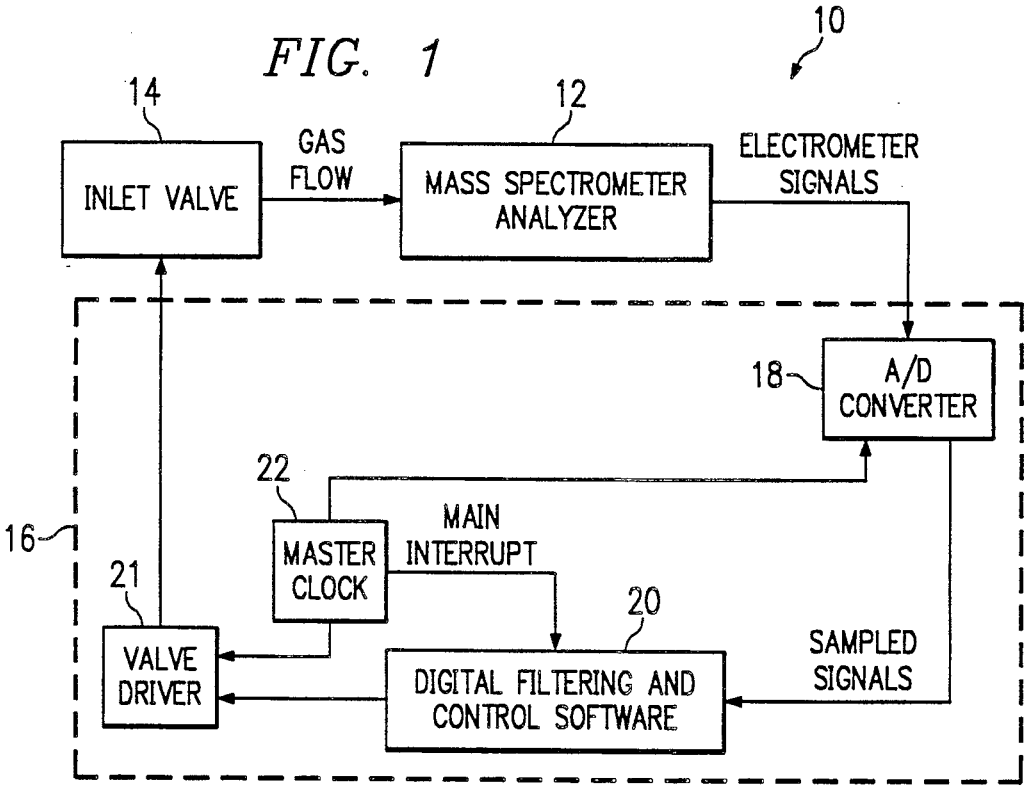
FIG. 1 is a block diagram of the preferred embodiment of the chopped mode mass spectrometer for reducing the effects of a line signal on the operation of the mass spectrometer.

FIG. 1 illustrates the preferred embodiment of a chop mode mass spectrometer 10, hereinafter mass spectrometer 10, for reducing the effects of a line signal on the operation of the mass spectrometer 10. While the operation of the mass spectrometer 10 is described hereinafter with respect to the 60 Hz line signal present in the United States, it should be appreciated that the mass spectrometer 10 can be adapted to accommodate line signals having different frequencies, such as the 55 Hz line signal used in Europe.

The mass spectrometer 10 includes an analyzer 12 for separating the molecular constituents of a gas sample according to their respective masses and detecting the degree to which at least one type of molecule is present in the gas sample. The analyzer 12 includes an evacuated chamber, a vacuum pump, an ion source, acceleration and focusing circuitry, a mass filter, and at least one detector that is positioned to detect the presence or absence of at least one type of molecule in the gas sample. The operation of these components of the analyzer 12 is well known in the art. Consequently their operation is not described herein.

The mass spectrometer 10 further includes an inlet valve 14 that is capable of reciprocating operation and is used to regulate the amount of gas admitted into the analyzer 12.

The mass spectrometer 10 also includes circuitry 16 for controlling the operation of the inlet valve 14 and processing the signal output by the analyzer 12. The circuitry 16 includes an analog-to-digital (A/D) converter 18 for converting the output signal of the analyzer 12, an analog signal, into a digital signal that can be digitally filtered to obtain the signals of interest and substantially eliminate or reduce the effect of the line signal. The front end of the A/D converter 18 includes a broad band amplifier for amplifying the output signal of the analyzer 12 before it is converted into a digital signal. The front end of the A/D converter 18 also includes a low-pass filter for attenuating the portion of the signal output by the analyzer 12 that, if allowed to propagate through to the digital signal, would cause aliasing errors in the digital filtering performed on the digital signal. The rear end of the A/D converter 18 includes circuitry for sampling and converting the signal output by the analyzer 12, which has been amplified and low-pass filtered by the front end of the A/D converter 18, into a digital signal.

The circuitry 16 further includes a digital processor 20 for processing the digital signal output by the A/D converter 18 and enabling operation of a valve driver 21. Preferably, the digital processor 20 is implemented with a suitably programmed computer. However, the digital processor 20 can be implemented using hardware specifically designed to accomplish the necessary processing and control functions.

The circuitry 16 also includes a clock 22 for providing a clock signal to the valve driver 21 and the A/D converter 18. With respect to the valve driver 21, the clock signal determines the frequency at which the valve 12 admits gas into the analyzer 12. With respect to the A/D converter 18, the clock signal is used to determine the rate at which the output signal of the analyzer 12 is sampled and converted into a digital signal. The clock 22 also provides an interrupt signal to the digital processor 20 that is used to place the mass spectrometer 10 in a known state following a power up or reset condition.

Operation of the mass spectrometer 10 is commenced by the clock 22 applying an interrupt signal to the digital processor 20 following a power-up or reset condition. In response to the interrupt, the digital processor 20 enables the valve driver 21 that, in turn, causes the inlet valve 14 to admit samples of gas into the analyzer 12 at a frequency determined by the clock signal. The analyzer 12 processes the gas samples admitted by the inlet valve 14 and produces an output signal where the information of interest lies in the portion of the signal that corresponds to the frequency at which the inlet valve 14 is admitting gas samples to the analyzer 12. For example, if the inlet valve is being driven by a 20 Hz clock signal, i.e., the inlet valve 14 is admitting twenty samples of gas every second, then the 20 Hz component of the signal output by the analyzer 12 indicates the presence or absence of a particular type of molecule in the gas sample. Providing the undesirable signals are of a frequency that is considerably lower than the frequency at which the inlet valve 14 is admitting gas samples to the analyzer 12, the effect of these signals is substantially isolated in the DC portion of the signal output by the analyzer 12.

While the technique of pulsing the valve 14 of the mass spectrometer 10 can be used to reduce the effects of undesirable signals that have a relatively low frequency with respect to the frequency at which the valve 14 is being pulsed, there are limitations to this technique. Namely, the bandwidth of the analyzer 12 and the valve 14 limits the maximum frequency at which the valve 14 can be driven to approximately 30 Hz. Consequently, the inlet valve 14 cannot be driven at a high enough frequency to eliminate the effects of a line signal, i.e., the 60 Hz signal used in the U.S. to power the mass spectrometer 10 or machinery located adjacent to the mass spectrometer 10, on the operation of the mass spectrometer 10.

To reduce the effect of the line signal on the operation of the mass spectrometer 10, the inlet valve 14 is driven at a frequency that is a sub-multiple of the line frequency. By pulsing the inlet valve 14 at a sub-multiple of the line frequency, a digital filtering technique can be implemented that substantially eliminates the effects of the line signal on the component of the signal output by the analyzer 12 that is of interest, i.e., the component corresponding to the frequency at which the inlet valve 14 is being driven.

The A/D converter 18 samples the output signal of the analyzer 12 at a frequency that is a multiple of the frequency at which the inlet valve 14 is admitting samples of gas into the analyzer 12, i.e., the frequency that is a sub-multiple of the line frequency. Preferably, the A/D converter 18 samples the output signal at a frequency that is eight times greater than the frequency at which the inlet valve 14 is admitting gas samples to the analyzer 12.

The digital signals produced by the A/D converter 18 are applied to the digital processor 20 where they are digitally filtered to recover the component of the digital signal that corresponds to the frequency at which the inlet valve 14 is admitting gas samples the analyzer 12 and to substantially reject the component of the digital signal that corresponds to the line frequency. In one embodiment, a discrete fourier transform (DFT) is used to filter the digital signal and obtain the frequency component of the digital signal that corresponds to the frequency at which the inlet valve 14 is being driven. Other digital techniques, like fast fourier transforms (FFT), can also be utilized to achieve the requisite filtering. Moreover, if greater accuracy is desired, a synchronous scheme with the appropriate digital filtering technique can be employed. Preferably, the DFT is implemented in software. However, hardware implementations of the DFT are also feasible. For the situation where the A/D converter 18 is sampling the output signal of the analyzer 12 at a frequency that is eight times the frequency at which the inlet valve 14 is being pulsed, the derivation of the sine and cosine components for the component of the digital signal that corresponds to the drive frequency of the valve 14 are as follows when a DFT is used:

$$\text{sin-component} = A\cdot O + B\cdot(0.707) + C\cdot 1 = D\cdot(0.707)$$

$$+E\cdot O + F\cdot(-0.707) + G\cdot(-1)$$
$$+H\cdot(-0.707)$$

$$\text{cos-component} = A\cdot 1 + B\cdot(0.707) + C\cdot O + D\cdot(-0.707)$$

$$+E(-1) + F\cdot(-0.707) + G\cdot O + H\cdot(0.707)$$

where A-H denote the values of the eight samples. The foregoing equations reduce to the following:

$$\text{sin-component} = (C-G) + (B+D-F-H)\cdot(0.707)$$

$$\text{cos-component} = (a-E) + (B-D-F+H)\cdot(0.707)\cdot$$

The magnitude of the frequency component of the digital signal that corresponds to the frequency at which the inlet valve 14 is being driven is determined from the sine and cosine components as follows:

$$\text{magnitude} = \text{sqrt}\left((\text{sin-component})^2 + (\text{cos-component})^2\right).$$

A fully implemented DFT would also determine the coefficients for all the components of the digital signal that are multiples of the frequency at which the valve 14 is being pulsed. Consequently, a fully implemented DFT would contain a component that corresponds to the line frequency. Since there is a component that corresponds to the line frequency, substantially all of the line signal is isolated in this component and, as a consequence, does not affect the component that corresponds to the frequency at which the inlet valve 14 is being driven. In contrast, if the inlet valve 14 is driven at a frequency other than a sub-multiple of the line frequency, then the line frequency affects the component of the digital signal that corresponds to the frequency at which the inlet valve 14 is being pulsed and more complex processing is required to eliminate its effect. Since substantially the entire effect of the line signal is isolated from the component corresponding to the drive frequency of the valve 14, "filtering" is accomplished by implementing a partial DFT that does not determine the component corresponding to the line frequency.

Figure 2:
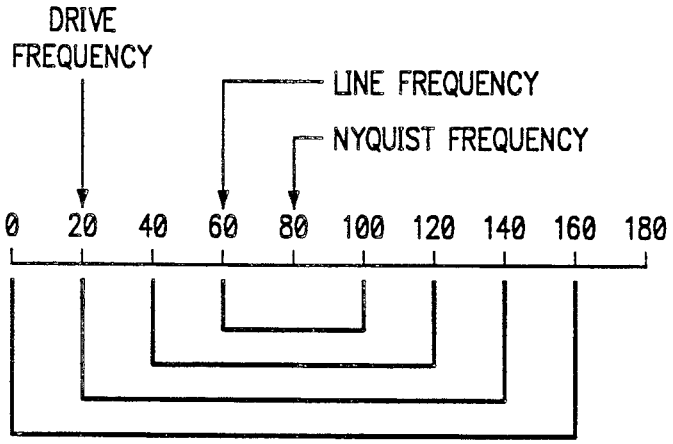
FIG. 2 illustrates the isolation of the 60 Hz line signal from the signals of interest when the valve is chopped at 20 Hz, a sub-multiple of the 60 Hz line frequency in the U.S., sampled at a frequency eight times the frequency at which the valve is being chopped, and digitally filtered.

FIG. 2 illustrates the case where the inlet valve 14 is pulsed at a frequency of 20 Hz, one-third of the 60 Hz line signal, and the A/D converter 18 samples the output signal of the analyzer 12 at a rate of 160 Hz, eight times the frequency at which the inlet valve 14 is being pulsed. Because the valve is drive at a submultiple of the line frequency and the sampling is done at a multiple of the frequency at which the inlet valve 14 is being driven, virtually the entire effect of the line signal is isolated in the 60 Hz component. Consequently, the 20 Hz signal produced by the DFT is substantially unaffected by the line signal.

Another advantage of implementing a digital filter is that it can be implemented relatively quickly and inexpensively in software. Consequently, relatively inexpensive broad band amplifiers can be utilized at the front end of the A/D converter 18. If, on the other hand, a digital filter is not utilized, then relatively expensive tuned amplifiers must be used to amplify the signal output by the analyzer 12.

Figure 3:
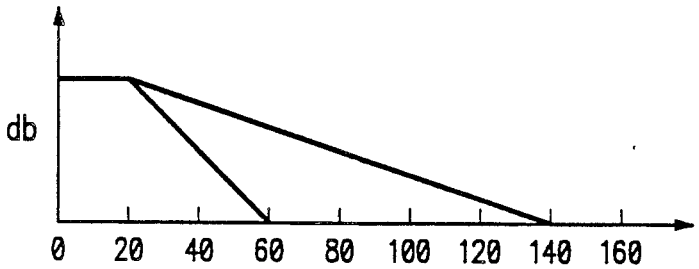
FIG. 3 illustrates the less severe roll-off criteria required of the analog filter when a sampling rate of 160 Hz is utilized in comparison to the roll-off criteria required of the analog filter when a sampling rate of 80 Hz is used.

With continuing reference to FIG. 2, a phenomena associated with the digital filtering done by the digital processor 20 is that the discrete frequency components above the Nyquist frequency, one-half the sampling frequency, "fold" into and affect the values of the discrete frequency components below the Nyquist frequency. In the illustrated case, the Nyquist frequency is 80 Hz. As shown, the 140 Hz signal "folds over" and affects the 20 Hz signal, which is the signal of interest. To eliminate the effects of "folding," the output signal of the analyzer 12 is applied to the low-pass filter at the front end of the A/D connecter 18 to attenuate the frequency components above the Nyquist frequency before the signal is sampled and applied to the digital processor 20. By increasing the sampling frequency, the particular frequency component above the Nyquist frequency that would, but for the filtering, affect the 20 Hz signal is further removed from the 20 Hz signal. Consequently, the roll-off criteria of the analog filter is reduced. For example and with reference to FIG. 3, the roll-off criteria that an analog filter needs to satisfy to adequately attenuate the 140 Hz frequency component when a sampling rate of 160 Hz is utilized is less severe than the roll-off criteria that must be satisfied to attenuate the 60 Hz signal when a sampling rate of 80 Hz is utilized.

The foregoing description of the invention has been presented for purposes of illustration and description. Further, the description is not intended to limit the invention to the form disclosed herein. Consequently, variations and modifications commensurate with the above teaching, and the skill or knowledge of the relevant art are within the scope of the present invention. The preferred embodiment described hereinabove is further intended to explain the best mode known of practicing the invention and to enable others skilled in the art to utilize the invention in various embodiments and with the various modifications required by their particular applications or uses of the invention. It is intended that the appended claims be construed to include alternate embodiments to the extent permitted by the prior art.

What is claimed is:

1. A chop mode mass spectrometer comprising:

an analyzer body for processing a sample of a gas and providing a signal representative of the degree to which at least one type of molecule is present in said sample;

a valve for admitting said sample into said analyzer body, said valve being capable of periodic operation;

means for driving said valve at a first defined frequency, wherein said first defined frequency is a sub-multiple of a line frequency; and means for processing said signal to detect the component of said signal corresponding to said sub-multiple of a line frequency and reject the component corresponding to said line frequency.

2. A chop mode mass spectrometer, as claimed in claim 1, wherein:

said means for processing includes a broad band amplifier.

3. A chop mode mass spectrometer, as claimed in claim 1, wherein:

said means for processing includes means for sampling said signal at a second defined frequency.

4. A chop mode mass spectrometer, as claimed in claim 3, wherein:

said means for processing includes a low-pass filter for attenuating frequency components of said signal above a frequency of approximately one half of said second defined frequency.

5. A chop mode mass spectrometer, as claimed in claim 3, wherein:

said second defined frequency is a multiple of said first defined frequency.

6. A chop mode mass spectrometer, as claimed in claim 1, wherein:

said means for processing includes an analog-to-digital converter for converting said signal to a digital signal.

7. A chop mode mass spectrometer, as claimed in claim 6, wherein:

said means for processing includes digital transform means for filtering said digital signal to detect said component of said signal corresponding to said sub-multiple of a line frequency and attenuate said component corresponding to said line frequency.

8. A method for operating a mass spectrometer in chopped mode, comprising:

providing an analyzer body for processing a sample of a gas and providing a signal representative of the degree to which at least one type of molecule is present in said sample;

providing a valve for admitting said sample into said analyzer body, said valve being capable of periodic operation;

driving said valve at a first defined frequency wherein said first defined frequency is a sub-multiple of a line frequency; and processing said signal to detect the component of said signal corresponding said sub-multiple of a line frequency and reject said component of said signal corresponding to said line frequency.

9. A method, as claimed in claim 8, wherein:

said step of processing includes applying said signal to a broad band amplifier.

10. A method, as claimed in claim 8, wherein:

said step of processing includes sampling said signal at a second defined frequency.

11. A method, as claimed in claim 8, wherein:

said step of sampling said signal includes applying said signal to a low-pass filter for attenuating the components of said signal above a frequency of approximately one half of said second defined frequency.

12. A method, as claimed in claim 8, wherein:

said second defined frequency is a multiple of said first defined frequency.

13. A method, as claimed in claim 8, wherein:

said step of sampling includes applying said signal to an analog-to-digital converter to convert said signal to a digital signal.

14. A method, as claimed in claim 8, wherein:

said step of processing said signal includes using a digital transform to filter said digital signal to detect said component of said digital signal corresponding to said sub-multiple of a line frequency and attenuate the component of said signal corresponding to said line frequency.

* * * * *